US008343889B2

(12) United States Patent
Yamashita et al.

(10) Patent No.: US 8,343,889 B2
(45) Date of Patent: Jan. 1, 2013

(54) THERMAL TRANSFER SHEET

(75) Inventors: Hiroyuki Yamashita, Tokyo-to (JP); Tadahiro Ishida, Tokyo-to (JP); Keiji Hirose, Tokyo-to (JP); Hirotaka Watanabe, Tokyo-to (JP); Toshikazu Kuwabara, Tokyo-to (JP); Daisuke Fukui, Tokyo-to (JP); Hideo Ito, Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 1179 days.

(21) Appl. No.: 12/096,212

(22) PCT Filed: Dec. 8, 2006

(86) PCT No.: PCT/JP2006/324584

§ 371 (c)(1),
(2), (4) Date: Aug. 7, 2008

(87) PCT Pub. No.: WO2007/066770

PCT Pub. Date: Jun. 14, 2007

(65) Prior Publication Data

US 2009/0130348 A1 May 21, 2009

(30) Foreign Application Priority Data

Dec. 9, 2005 (JP) ..... 2005-355639
Sep. 29, 2006 (JP) ..... 2006-267391

(51) Int. Cl.
*B41M 5/385* (2006.01)

(52) U.S. Cl. ..... 503/227

(58) Field of Classification Search ..... None
See application file for complete search history.

(56) References Cited

U.S. PATENT DOCUMENTS

2005/0153081 A1 7/2005 Chang et al.

FOREIGN PATENT DOCUMENTS

| | | |
|---|---|---|
| JP | 59-078897 | 5/1984 |
| JP | 5-69718 | 1/1993 |
| JP | 07-102746 | 8/1995 |
| JP | 2003-312151 | 11/2003 |
| JP | 2005-231354 | 9/2005 |

(Continued)

OTHER PUBLICATIONS

International Search Report; PCT/JP2006/324584.

(Continued)

*Primary Examiner* — Bruce H Hess
(74) *Attorney, Agent, or Firm* — Ladas & Parry LLP

(57) ABSTRACT

It is an object of the present invention to provide a thermal transfer sheet which has a high transfer sensitivity in thermal transfer printing to obtain a high density print, has a high sharpness of thermal transfer images, can prevent an abnormal transfer in printing even after being stored at high temperature and high humidity, and can provide a sufficiently satisfactory printed matter.

The above object is achieved by a thermal transfer sheet comprising: a substrate; a heat resistant slip layer provided on one side of the substrate; an undercoat layer and a dye layer provided in that order on the other side of the substrate, wherein the undercoat layer is formed by applying and drying a coating liquid which contains, as main components, a water soluble self cross-linking resin and colloidal inorganic pigment ultrafine particles, and cross-linking polymerizing the water soluble self cross-linking resin, or wherein the undercoat layer is formed by using colloidal inorganic pigment ultrafine particles and a copolymer resin of vinyl pyrrolidone and vinyl acetate as main components.

4 Claims, 1 Drawing Sheet

FOREIGN PATENT DOCUMENTS

| | | |
|---|---|---|
| JP | 2005-262594 | 9/2005 |
| JP | 2006-150956 | 6/2006 |
| JP | 2006-256187 | 9/2006 |
| WO | 2005/063497 | 7/2005 |
| WO | 2006/049221 | 5/2006 |

OTHER PUBLICATIONS

European Search Report: EP 06 83 4339.

THERMAL TRANSFER SHEET

TECHNICAL FIELD

The present invention relates to a thermal transfer sheet provided with: a substrate, on one surface of which a heat resistant slip layer provided on, and on the other surface of which an undercoat layer and a dye layer are provided in that order, in which the undercoat layer contains inorganic oxide and organic resin. More specifically, the present invention relates to a thermal transfer sheet having a high transfer sensitivity during a high speed printing, and allowing a high density print, and preventing abnormal transfer in printing even after being stored at high temperature and high humidity, so that more than satisfactory printed matter is obtained.

BACKGROUND ART

Various thermal transfer recording methods have hitherto been known in the art. Among others, a method is proposed to form various full color images by utilizing sublimation dye as a recording material, and thermally transferring the sublimation dye from a thermal transfer sheet onto a transfer-receiving material which can be dyed with sublimation dye, wherein the thermal transfer sheet comprises a dye layer formed by holding the sublimation dye by a suitable binder on a substrate such as a polyester film, and wherein the transfer-receiving material includes the thermal transfer image-receiving sheet comprising a dye receiving layer provided on paper, plastic film or the like. In this case, a large number of color dots of three or four colors with the quantity of heat being regulated are transferred by heating by means of a thermal head as heating means in a printer onto the receiving layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography.

In the thermal transfer recording method utilizing the sublimation transfer, an increase in printing speed of thermal transfer printers has posed a problem that conventional thermal transfer sheets cannot provide satisfactory print density. Further, high density and high sharpness have become required of prints of images formed by thermal transfer. Therefore, image quality becomes lowered at a black high density area when a black thermal transfer image is formed by superimposing sequentially three color dyes including each dye layer of yellow, magenta and cyan, and a protective layer which is finally transferred from a protective layer transfer sheet. More specifically, a phenomenon, so-called "burnt deposit" comes to appear, since the receiving layer of the thermal transfer image-receiving sheet fuses to the dye layer of the thermal transfer sheet. In this context, the "burnt deposit" is a phenomenon that a change of color phase occurs in a black part and thereby the surface of the printed matter becomes matte and lose luster. For this reason, many attempts have been made in order to improve a thermal transfer sheet or a thermal transfer image-receiving sheet onto which an image is formed by receiving a sublimation dye which is transferred from the thermal transfer sheet. For example, an attempt has been made in order to improve transfer sensitivity in printing by reducing a thickness of the thermal transfer sheet. However, this method has a problem that wrinkles are caused or even breakage is occurred, due to heat, pressure or the like, during production of the thermal transfer sheet or during thermal transfer recording.

Another attempt has been made in order to improve transfer sensitivity in printing or improve a print density, by increasing a ratio of dye to binder resin (dye/binder) in the dye layer of a thermal transfer sheet. In this method, however, during storage in a wound state, the dye is transferred onto the heat-resistant slip layer provided on the backside of the thermal transfer sheet, and, at the time of rewinding, the dyes transferred onto the heat-resistant slip layer are retransferred (kicked back) onto dye layers of other colors or the like. If the contaminated dye layer is thermally transferred onto a thermal image-receiving sheet, the color is deviated from the designated color or a phenomenon, so-called "scumming" is caused. Further, there have been attempts that high energy is applied on a thermal transfer printer, different from a thermal transfer sheet, during thermal transferring to form an image. In this method, however, a dye layer is likely to fuse to the image-receiving layer, resulting in an abnormal transfer. If a great amount of releasing agent is added to the image-receiving layer in order to prevent the abnormal transfer, image blurring or scumming arises.

For example, Patent Document 1 proposes a thermal transfer sheet provided with: a substrate; an adhesive layer formed on the substrate and containing a water soluble curing agent and a water soluble resin having activated hydrogen; and a dye layer formed on the adhesive layer. Patent Document 2 discloses a thermal transfer sheet wherein a hydrophilic barrier/subbing layer comprising polyvinylpyrrolidone as a main component and, mixed with the main component, polyvinyl alcohol as a component for enhancing dye transfer efficiency is provided between a dye layer and a support. Furthermore, Patent Document 3 discloses a thermal transfer sheet provided with: a base film; and a recording layer containing sublimation dye, between of which an intermediate layer is provided. This intermediate layer contains another sublimation dye having a diffusion coefficient smaller than that of the sublimation dye contained in the recording layer. In this reference, it is only mentioned that hydroxyethyl cellulose is used as the intermediate layer.

In the thermal transfer sheet of Patent Document 1, the curing agent needs to be added to the adhesive layer to cure the water soluble resin. And, it is required to control an amount of the curing agent to be added. If the curing reaction is insufficient, more amount of dye transfers to the adhesive layer, and less amount of dye transfers from the dye layer to the image-receiving sheet. As a result, a high density print cannot be obtained. Furthermore, since the cohesion of the adhesive layer (undercoat layer) is insufficient, an abnormal transfer occurs in the print after being stored at high temperature and high humidity. On the other hand, in thermal transfer sheets of Patent Documents 2 and 3, the printed matter obtained by using these transfer sheets does not achieve the sufficient level of the maximum density.

Other prior art documents, Patent Documents 4 and 5 disclose that an intermediate layer containing a metal or a metal oxide is provided between a substrate and a dye layer in a thermal transfer sheet. Patent Document 4 discloses, in its Example, that a dye is transferred onto an activated clay paper by using a thermal transfer sheet obtained by depositing a metal or a metal oxide on a substrate and depositing a thin layer of dye thereon. However, thus obtained thermal transfer sheet cannot provide the sufficient sharpness and the sufficiently high density of the thermal transfer image. Furthermore, the production cost is high, since a special apparatus is required for depositing.

In Patent Document 5, an easily adhesive layer is provided between a thermal transfer sheet substrate and a dye layer. The easily adhesive layer contains a homopolymer of N-vinylpyrrolidone, or a copolymer of N-vinylpyrrolidone with other components. Furthermore, in order to improve the adhesiveness, an inorganic filler such as ultraviolet (UV) absorber, or other fillers such as silica or alumina is added to the easily adhesive layer. However, the easily adhesive layer shows low transfer sensitivity and cannot provide the high density print, although the adhesiveness with the substrate of the dye layer can be improved.

In order to improve the transfer sensitivity in printing, for example Patent Document 6 proposes a thermal transfer sheet provided with an adhesive layer containing polyvinylpyrrolidone resin and modified polyvinylpyrrolidone resin between a substrate and a dye layer. However, this thermal transfer sheet cannot provide a sufficient level of the print density, although the abnormal transfer can be prevented.

Furthermore, Patent Document 7 discloses a thermal transfer sheet provided with an adhesive layer between a substrate and a dye layer, in which the adhesive layer contains a thermoplastic resin which is a polyvinylpyrrolidone resin or polyvinylalcohol resin; and colloidal inorganic pigment ultrafine particles. However, this thermal transfer sheet may cause the abnormal transfer, in printing after being stored at high temperature and high humidity.

As mentioned above, there have not been found a thermal transfer sheet which can provide a high transfer sensitivity in printing, and a high density print, and can prevent an abnormal transfer in printing even after being stored at high temperature and high humidity.

Patent Document 1: Japanese Patent Application Laid-open No. 2005-262594

Patent Document 2: Japanese Patent examined-Application Publication No. H7-102746

Patent Document 3: Japanese Patent examined-Application Publication No. H5-69718

Patent Document 4: Japanese Patent Application Laid-open No. S59-78897

Patent Document 5: Japanese Patent Application Laid-open No. 2003-312151

Patent Document 6: Japanese Patent Application Laid-open No. 2005-231354

Patent Document 7: Japanese Patent Application Laid-open No. 2006-150956

DISCLOSURE OF THE INVENTION

Problem to be Solved by the Invention

The present invention has been accomplished in view of the above problems. It is therefore an object of the invention to provide a thermal transfer sheet which has a high transfer sensitivity in thermal transfer printing to obtain a high density print, has a high sharpness of thermal transfer images, can prevent an abnormal transfer in printing even after being stored at high temperature and high humidity, and can provide a sufficiently satisfactory printed matter.

Means for Solving the Problems

The first aspect of the thermal transfer sheet according to the present invention is a thermal transfer sheet comprising: a substrate; a heat resistant slip layer provided on one side of the substrate; an undercoat layer and a dye layer provided in that order on the other side of the substrate, wherein the undercoat layer is formed by applying and drying a coating liquid which contains, as main components, a water soluble self cross-linking resin and colloidal inorganic pigment ultrafine particles, and cross-linking polymerizing the water soluble self cross-linking resin.

According to the first aspect, since the undercoat layer is formed by applying and drying a coating liquid which contains, as main components, a water soluble self cross-linking resin and colloidal inorganic pigment ultrafine particles, and cross-linking polymerizing the water soluble self cross-linking resin, it is possible to provide a thermal transfer sheet which has a high transfer sensitivity in thermal transfer printing to obtain a high density print, has a high sharpness of thermal transfer images, can prevent an abnormal transfer in printing even after being stored at high temperature and high humidity, and can provide a sufficiently satisfactory printed matter.

In the first aspect of the thermal transfer sheet according to the present invention, the water soluble self cross-linking resin is preferably polyamide epoxy resin.

In the first aspect of the thermal transfer sheet according to the present invention, the colloidal inorganic pigment ultrafine particles are preferably of colloidal silica and/or alumina sol.

In the first aspect of the thermal transfer sheet according to the present invention, a solid content ratio by weight of the colloidal inorganic pigment ultrafine particles to the water soluble self cross-linking resin (the colloidal inorganic pigment ultrafine particles/the water soluble self cross-linking resin) is preferably 1/1 to 1/0.05.

The second aspect of the thermal transfer sheet according to the present invention is a thermal transfer sheet comprising: a substrate; a heat resistant slip layer provided on one side of the substrate; an undercoat layer and a dye layer provided in that order on the other side of the substrate, wherein the undercoat layer is formed by using colloidal inorganic pigment ultrafine particles and a copolymer resin of vinyl pyrrolidone and vinyl acetate as main components.

According to the second aspect of the present invention, since the undercoat layer is formed by using colloidal inorganic pigment ultrafine particles and a copolymer resin of vinyl pyrrolidone and vinyl acetate as main components, it is possible to provide a thermal transfer sheet which has a high transfer sensitivity in thermal transfer printing to obtain a high density print, has a high sharpness of thermal transfer images, can prevent an abnormal transfer in printing even after being stored at high temperature and high humidity, additionally, can reduce the "burnt deposit" phenomenon at a black high density area where three color dyes, yellow, magenta and cyan, are sequentially superimposed, and thus can provide a sufficiently satisfactory printed matter.

In the second aspect of the thermal transfer sheet according to the present invention, a polymerization ratio by mol of the vinyl pyrrolidone to the vinyl acetate in the copolymer (vinyl pyrrolidone/vinyl acetate) is preferably 70/30 to 30/70.

In the second aspect of the thermal transfer sheet according to the present invention, the colloidal inorganic pigment ultrafine particles are preferably of colloidal silica and/or alumina sol.

In the second aspect of the thermal transfer sheet according to the present invention, a coating amount of the undercoat layer is preferably 0.15 to 0.25 g/m$^2$ on a dry basis, in view of reducing the "burnt deposit".

In the second aspect of the thermal transfer sheet according to the present invention, a solid content ratio by weight of the colloidal inorganic pigment ultrafine particles to the copolymer resin of vinyl pyrrolidone and vinyl acetate (colloidal inorganic pigment ultrafine particles/copolymer resin of vinyl pyrrolidone and vinyl acetate) is preferably 8/2 to 6/4, in view of reducing the "burnt deposit".

Effect of the Invention

In the first aspect of the thermal transfer sheet according to the present invention, since the undercoat layer is formed by applying and drying a coating liquid which contains, as main components, a water soluble self cross-linking resin and colloidal inorganic pigment ultrafine particles, and cross-linking polymerizing the water soluble self cross-linking resin, it is possible to provide a thermal transfer sheet which has a high transfer sensitivity in thermal transfer printing to obtain a high density print, has a high sharpness of thermal transfer images, can prevent an abnormal transfer in printing even after being stored at high temperature and high humidity, and can provide a sufficiently satisfactory printed matter. The undercoat layer is made from a liquid containing the above-mentioned water soluble self cross-linking resin, colloidal inorganic pigment ultrafine particles and aqueous solvent. And, the liquid is applied on the substrate and dried, so that the water soluble self cross-linking resin cross-links to form a water insoluble network structure. Thereby, it is possible to improve the cohesion of the undercoat layer. Therefore, during a thermal transferring in combination with a thermal transfer image-receiving sheet, the abnormal transfer of the dye layer to the receiving sheet can be prevented. The undercoat layer is hardly to be dyed from the dye layer. Thereby, it is possible to prevent the dye transferring from the dye layer to the undercoat layer during printing, and perform effectively the dye diffusion to the receiving layer of the receiving sheet. Thereby, it is possible to improve the transfer sensitivity in printing and improve the print density.

In the second aspect of the thermal transfer sheet according to the present invention, since the undercoat layer is formed by using colloidal inorganic pigment ultrafine particles and a copolymer resin of vinyl pyrrolidone and vinyl acetate as main components, it is possible to provide a thermal transfer sheet which has a high transfer sensitivity in thermal transfer printing to obtain a high density print with less "burnt deposit", has a high sharpness of thermal transfer images, can prevent an abnormal transfer in printing even after being stored at high temperature and high humidity, and can provide a sufficiently satisfactory printed matter. It is considered that the vinyl acetate component of the copolymer resin compensates for a property of the polyvinyl pyrrolidone resin such as low humidity resistance and likelihood of causing the "burnt deposit". Thus the copolymer of vinyl pyrrolidone with vinyl acetate for the undercoat layer has functions such that the adhesiveness between the dye layer and the substrate after being stored at high temperature and high humidity is improved, the abnormal transfer in printing is prevented, and the "burnt deposit" is reduced during a high speed printing. The colloidal inorganic pigment ultrafine particles in the undercoat layer improve the transfer sensitivity of the thermal transfer print and mainly contribute to the improvement of the print density. Particularly, in the case that the coating amount of the undercoat layer is 0.15 to 0.25 g/m$^2$ on a dry basis, and the weight ratio of colloidal inorganic pigment ultrafine particles to the copolymer resin is 8/2 to 6/4, it is possible to obtain the printed matter with less "burnt deposit" and to prevent the abnormal transfer in printing after being stored at high temperature and high humidity.

EXPLANATION OF REFERENCE NUMERALS

1: a substrate
2: an undercoat layer
2': an undercoat layer
3: a dye layer
4: a heat resistant slip layer

BEST MODE FOR CARRYING OUT THE INVENTION

The first aspect of the thermal transfer sheet according to the present invention is a thermal transfer sheet comprising: a substrate; a heat resistant slip layer provided on one side of the substrate; an undercoat layer and a dye layer provided in that order on the other side of the substrate, wherein the undercoat layer is formed by applying and drying a coating liquid which contains, as main components, a water soluble self cross-linking resin and colloidal inorganic pigment ultrafine particles, and cross-linking polymerizing the water soluble self cross-linking resin.

The second aspect of the thermal transfer sheet according to the present invention is a thermal transfer sheet comprising: a substrate; a heat resistant slip layer provided on one side of the substrate; an undercoat layer and a dye layer provided in that order on the other side of the substrate, wherein the undercoat layer is formed by using colloidal inorganic pigment ultrafine particles and a copolymer resin of vinyl pyrrolidone and vinyl acetate as main components.

In this context, the "main component" may include other components in addition to the above-defined resin and ultrafine particles, insofar as the effect of the invention is maintained, in which a total amount of the above-mentioned resin and ultrafine particles is more than 50% by weight relative to total solid components. More preferably, the total amount of the above-mentioned resin and ultrafine particles is more than 90% by weight, and especially more than 95% by weight.

Figure 1:
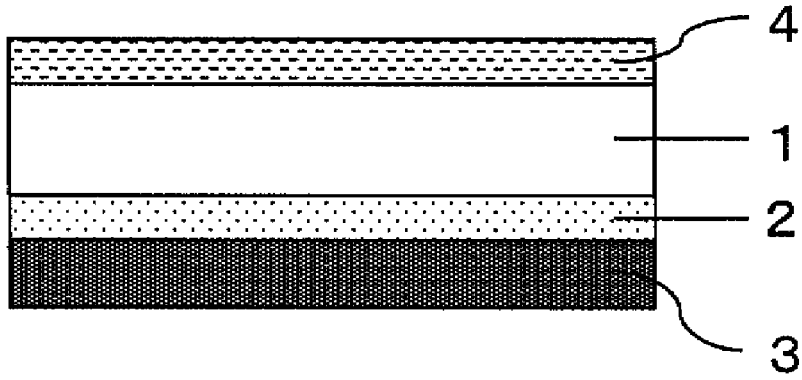
FIG. 1 is a schematic sectional view showing an embodiment of the first aspect of the thermal transfer sheet of the present invention.

FIG. 1 shows an embodiment of the first aspect of the thermal transfer sheet of the present invention. In FIG. 1, a heat resistant slip layer 4 is provided on one surface of a substrate 1, in order to improve the slipping property of a thermal head and prevent a sticking. On another surface of the substrate 1, an undercoat layer 2 and a dye layer 3 are provided in that order, wherein the undercoat layer 2 contains, as a main component, a cross-linked structure of water soluble self cross-linking resin and colloidal inorganic pigment ultrafine particles.

Figure 2:
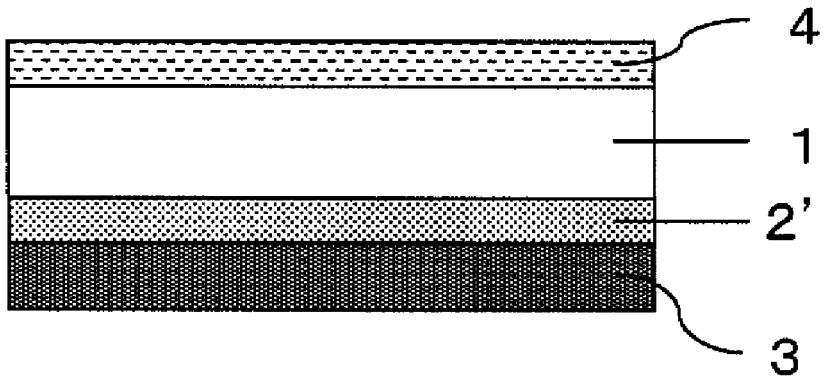
FIG. 2 is a schematic sectional view showing an embodiment of the second aspect of the thermal transfer sheet of the present invention.

FIG. 2 shows an embodiment of the second aspect of the thermal transfer sheet of the present invention. In FIG. 2, a heat resistant slip layer 4 is provided on one surface of a substrate 1, in order to improve the slipping property of a thermal head and prevent a sticking. On another surface of the substrate 1, an undercoat layer 2' and a dye layer 3 are provided in that order, wherein the undercoat layer 2' contains, as a main component, a copolymer resin of vinyl pyrrolidone with vinyl acetate and colloidal inorganic pigment ultrafine particles.

The thermal transfer sheet of the present invention will now be explained in more detail, for each layer constituting the sheet.

(Substrate)

The substrate 1 of the thermal transfer sheet used in the present invention may be any known substrate having a certain extent of heat resistance and strength. For example, a film having a thickness of 0.5 to 50 μm, preferably 1 to 10 μm may be used, including polyethyleneterephthalate films, 1,4-polycyclohexylene dimethylene terephthalate films, polyethylene naphthalate films, polyphenylene sulfide films, polystyrene films, polypropylene films, polysulfone films, aramid films, polycarbonate films, polyvinylalcohol films, cellulose derivatives such as cellophane and cellulose acetate, polyethylene films, polyvinyl chloride films, nylon films, polyimide films, ionomer films and so on.

A surface of the substrate, where the undercoat layer and the subsequent dye layer are formed thereon, is often treated in order to improve the adhesiveness. When forming the undercoat layer, the substrate, for example the above-listed plastic films, is likely to have an insufficient adhesiveness relative to the undercoat layer. Therefore, the substrate such as the plastic film is preferably treated to improve its adhesiveness. A method for improving the adhesiveness may be any known method for improving the resin surface, such as corona discharge treatment, flame treatment, ozone treatment, ultraviolet treatment, radiation treatment, surface roughening treatment, chemical agent treatment, plasma treatment, low temperature plasma treatment, primer treatment, grafting treatment and so on. A combination of two or more of these treatment methods may also be used. The primer treatment may be carried out, for example, by coating, in melt extrusion of a plastic film to form a film, a primer liquid onto an unstretched film and then subjecting the assembly to stretching treatment. In the present invention, the corona discharge treatment or the plasma treatment is preferable among the above-listed methods, in view of availability at low cost.

(Undercoat Layer)

The undercoat layer, which is provided between the substrate and the dye layer, of the thermal transfer sheet of the present invention is formed by, in the first aspect of the invention, applying and drying a coating liquid containing, as main components, the water soluble self cross-liking resin and colloidal inorganic pigment ultrafine particles, and cross-linking polymerizing the water soluble self cross-linking resin (the undercoat layer 2). In the second aspect of the invention, the undercoat layer 2' is formed by using, as main components, a copolymer resin of vinyl pyrrolidone and vinyl acetate, and colloidal inorganic pigment ultrafine particles.

A publicly known compound can be used as the colloidal inorganic pigment ultrafine particles for the undercoat layer. For example, it may be silica (colloidal silica) alumina or alumina hydrate (such as alumina sol, colloidal alumina, cationic aluminum oxide or the hydrate thereof, and pseudo boehmite), aluminum silicate, magnesium silicate, magnesium carbonate, magnesium oxide, titanium oxide and so on. Particularly, colloidal silica or alumina sol is preferably used. As the undercoat layer, although only a single kind of these colloidal inorganic pigment ultrafine particles may be used, different kinds may be used in combination, for example a combination of colloidal silica and alumina sol. Primary average particle size of these colloidal inorganic pigment ultrafine particles is 100 nm or less, preferable 50 nm or less, and particularly 3 to 30 nm. Thereby, the undercoat layer can sufficiently fulfill its function. Shape of colloidal inorganic pigment ultrafine particles may be any shape, including sphere form, acicular form, plate form, feather form, infinite form and the like. Further, the colloidal inorganic pigment ultrafine particles may be treated to make them an acid type in order to improve the sol dispersibility into an aqueous solvent. Otherwise, electrical charge of ultrafine particles may be cationized, or ultrafine particles may be surface-treated.

The water soluble self cross-linking resin used in the first aspect of the undercoat layer may be, for example, polyamide epoxy resin (polyamideamine-epichlorohydrin resin), urea-formaldehyde resin, melamine-formaldehyde resin and so on. These water soluble self cross-linking resins preferably have an epoxy group, an aldehyde group and so on as a cross-linking functional group in one molecule, and preferably have a hydrophilic functional group such as an amino group and a carboxyl group. Particularly, among the above-listed water soluble self cross-linking resin, polyamide epoxy resin is preferably used, since the strength in a humid environment can be increased, the cohesion of the undercoat layer can be improved, and the dyeing property of dye can be reduced.

The above-mentioned, polyamide epoxy resin is polyamideamine-epichlorohydrin resin represented by the following formula ("*Kami to Kakou no Yakuhin Jiten* (Chemicals Dictionary for Paper and. Process)", pp. 245-246, issued on Feb. 25, 1991, by Tech Times). The above-mentioned, polyamide epoxy resin is also referred to as epoxidized polyamide resin. The subscript letter "n" can be appropriately selected so that the molecular weight of obtained polyamide epoxy resin is in a range of from about 1,000 to about 100,000. This molecular weight is a number average molecular weight. The molecular weight of polyamide epoxy resin which will be explained hereinafter all refers to a number average molecular weight.

Formula (1)

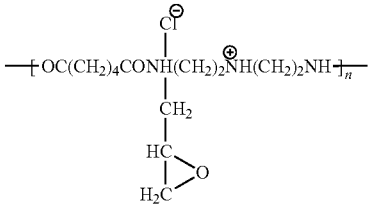

In the Formula (1), n indicates integer.

Polyamide epoxy resin is a cationic water soluble resin having a polymer skeleton including an amino group. In addition, since it has a side chain including an epoxy group, it has a self cross-linking property. In other words, it has a thermal cross-linking property and establishes a water insoluble network structure by heating. As the polyamide epoxy resin, a commercially available polyamide epoxy resin can be used, for example, Sumirez Resin 650, 675 and 6615 available from Sumika Chemtex Co., Ltd., and WS 4002, 4020, 4024 and 4046 available from SEIKO PMC CORPORATION. As polyamide epoxy resin to be used in the present invention, two or more kinds of polyamide epoxy resins may be used in combination.

On the other hand, a copolymer of vinyl pyrrolidone and vinyl acetate to be used in the second aspect of the undercoat layer is a copolymer of N-vinyl pyrrolidone monomer and vinyl acetate as vinyl polymerizable monomer. This copolymer may be any type of copolymers including random copolymer, block copolymer, graft copolymer and so on. The above-mentioned, N-vinyl pyrrolidone monomer refers N-vinyl pyrrolidone (such as N-vinyl-2-pyrrolidone and N-vinyl-4-pyrrolidone) and derivatives thereof. Examples of derivatives include N-vinyl-3-methylpyrrolidone, N-vinyl-5-methylpyrrolidone, N-vinyl-3,3,5-trimethyl pyrrolidone, N-vinyl-3-benzyl pyrrolidone and others which has a pyrrolidone ring substituted by any substituent group.

The copolymer of the vinylpyrrolidone and vinyl acetate has an improved adhesiveness between the substrate and the dye layer after being stored at high temperature and high humidity, can prevent the abnormal transfer in printing, and can exert the effect of reducing the "burnt deposit" phenomenon at a high density area of the printed matter in high speed printing. It is considered that the vinyl acetate component compensates for a property of the polyvinyl pyrrolidone resin such as a high hygroscopicity, low humidity resistance and likelihood of causing the "burnt deposit". In the copolymer of vinyl pyrrolidone and vinyl acetate, the polymerization ratio by mol of vinyl pyrrolidone to vinyl acetate (vinyl pyrrolidone/vinyl acetate) is preferably 70/30 to 30/70, in view of sufficiently exertion of the above effect. If the polymerization ratio of vinyl pyrrolidone is more than 70%, the effect of the vinyl acetate is not fully exerted. As a result, the adhesiveness with the substrate, especially at high temperature and high humidity, is likely to decrease. On the other hand, if the polymerization ratio of vinyl acetate is more than 70%, the dyeing property of dye from the dye layer increases and thereby the dye transferability to the receiving layer of the thermal transfer sheet decreases, thus resulting in less maximum density of print.

In the undercoat layer of the first aspect, the solid content ratio by weight of the colloidal inorganic pigment ultrafine particles to the water soluble self cross-linking resin (colloidal inorganic pigment ultrafine particles/water soluble self cross-linking resin) is preferably 1/1 to 1/0.05. If the compound ratio of the colloidal inorganic pigment ultrafine particles in the undercoat layer is too high, the cohesion force of the colloidal inorganic pigment ultrafine particles is likely to decrease in printing after being stored of the thermal transfer sheet at high temperature and high humidity. As a result, the thermal fusion or the abnormal transfer is likely to be caused in printing. If the compound ratio of the water soluble self cross-linking resin in the undercoat layer is too high, the dye moves to the undercoat layer, thus resulting in less transfer density in printing.

In the undercoat layer of the second aspect, the solid content ratio by weight of the colloidal inorganic pigment ultrafine particles to the copolymer resin of vinyl pyrrolidone and vinyl acetate (colloidal inorganic pigment ultrafine particles/copolymer resin of vinyl pyrrolidone and vinyl acetate) is preferably 8/2 to 6/4. If the compound ratio of the colloidal inorganic pigment ultrafine particles in the undercoat layer is too high, the cohesion force of the colloidal inorganic pigment ultrafine particles is likely to decrease in printing after being stored of the thermal transfer sheet at high temperature and high humidity. As a result, the thermal fusion, the "burnt deposit" or the abnormal transfer is likely to be caused in printing. If the compound ratio of the copolymer resin of vinyl pyrrolidone and vinyl acetate in the undercoat layer is too high, the dye is likely to move from the dye layer to the undercoat layer in printing, thus resulting in less transfer density. Furthermore, the thermal fusion or the abnormal transfer is likely to be caused in printing after being stored of the thermal transfer sheet at high temperature and high humidity.

In the case that the undercoat layer is formed by coating, the coating liquid for the undercoat layer preferably has a low viscosity with fluidity, in view of the coating suitability. The undercoat layer of the first aspect of the present invention is formed by applying and drying the coating liquid containing, as main components, the water soluble self cross-linking resin and colloidal inorganic pigment ultrafine particles, and cross-linking polymerizing the water soluble self cross-linking resin. The coating liquid is obtained by dispersing inorganic pigment ultrafine particles into an aqueous solvent in sol form and dissolving the water soluble self cross-linking resin into the aqueous solvent. This coating liquid is applied by any known method including gravure coating, roll coating, screen printing, reverse roll coating with gravure plate, and so on, and dried to form the undercoat layer. The coating amount of the undercoat layer formed in this manner is in the order of 0.02 to 1.0 g/m$^2$, preferably in the order of 0.02 to 0.3 g/m$^2$ on a dry basis.

The undercoat layer is formed by applying the coating liquid onto the substrate and drying by hot air or the like so that water or moisture is removed to transform the colloidal inorganic pigment ultrafine particles from sol state to gel state, while the water soluble self cross-linking resin as binder is self cross-linked by heating so that the coating layer fixed to the substrate is formed. The drying condition to form such a cross-linked coating layer may be, for example, heating at 50 to 130° C. for 30 seconds to 5 minutes, more preferably at 80 to 110° C. for 1 to 3 minutes. The cross-linked water soluble self cross-linking resin establishes a network structure and acquires water resistance. In such a network structure, the above-mentioned inorganic pigment ultrafine particles are dispersed in a gel state. The liquid may be dried with the anionic group of colloidal inorganic pigment ultrafine particles and the cationic group of the water soluble self cross-linking resin ionically bonded. Therefore, as for the undercoat layer of the present invention, a baking treatment by a general sol-gel method is not used.

Although the undercoat layer of the first aspect is formed by applying and drying the coating liquid made of the water soluble self cross-linking resin, colloidal inorganic pigment ultrafine particles and aqueous solvent, it is preferable that the obtained undercoat layer has no solvent component or has little amount of solvent. Thus, the undercoat layer made of the water soluble self cross-linking resin and the colloidal inorganic pigment ultrafine particles is formed as the coating layer between the substrate and the dye layer. Such an undercoat layer has an improved cohesion, so that the abnormal transfer from the dye layer to the image-receiving sheet is prevented when the thermal transfer sheet is thermal-transferred by heating with the thermal transfer image-receiving sheet. Furthermore, the undercoat layer has a structure in which the inorganic pigment ultrafine particles and the water soluble self cross-linking resin are cured, so that the undercoat layer is constructed by a material which is hardly dyed by the dye from the dye layer. Thereby, the undercoat layer can prevent the dye contamination from the dye layer to the undercoat layer during printing, and can perform the dye diffusion effectively to the receiving layer of the image-receiving sheet. Therefore, it is possible to improve the transfer sensitivity in printing and print density.

On the other hand, the undercoat layer of the second aspect is formed by applying an drying a coating liquid, which contains, as main components, colloidal inorganic pigment ultrafine particles and a copolymer resin of vinyl pyrrolidone and vinyl acetate. The coating liquid obtained by dispersing inorganic pigment ultrafine particles into an aqueous solvent in sol form and dissolving the copolymer of vinyl pyrrolidone and vinyl acetate into the aqueous solvent, is applied and dried to form the undercoat layer, by a known method. The coating amount of the undercoat layer formed in this manner is in the order of 0.02 to 1.0 g/m$^2$, preferably 0.15 to 0.25 g/m$^2$ on a dry basis. If the coating amount of the undercoat layer is too low, the dyeing property of the dye layer is likely to decrease after being stored at high temperature and high humidity, or the thermal fusion or the abnormal transfer is likely to be caused in printing. If the coating amount of the undercoat layer is too high, the "burnt deposit" is likely to be caused in printing.

The undercoat layer of the second aspect is formed by applying the coating liquid onto the substrate and drying by hot air or the like so that water or moisture is removed to transform the colloidal inorganic pigment ultrafine particles from sol state to gel state, while the copolymer of vinyl pyrrolidone and vinyl acetate as binder is fixed to the substrate to form a coating layer. Thus, the undercoat layer made of the copolymer resin of vinyl pyrrolidone and vinyl acetate and colloidal inorganic pigment ultrafine particles as main components, is formed as the coating layer between the substrate and the dye layer. Therefore, it is possible to improve the cohesion of the undercoat layer, and prevent the "burnt deposit" or the abnormal transfer from the dye layer to the image-receiving sheet when the thermal transfer sheet is thermal-transferred by heating with the thermal transfer image-receiving sheet. Furthermore, the undercoat layer has a structure of which main component is the inorganic pigment ultrafine particles and the copolymer of vinyl pyrrolidone and vinyl acetate, so that the undercoat layer is constructed by a material which is hardly dyed by the dye from the dye layer. Thereby, the undercoat layer can prevent the dye contamination from the dye layer to the undercoat layer during printing, and can perform the dye diffusion effectively to the receiving layer of the image-receiving sheet. Therefore, it is possible to improve the transfer sensitivity in printing and print density. It is considered that the colloidal inorganic pigment ultrafine particles mainly contribute to improving the transfer sensitivity in the thermal transfer printing and the print density.

(Dye Layer)

The thermal transfer sheet of the present invention is provided with the dye layer 3 via the undercoat layer on one surface of the substrate opposite to the surface onto which the heat resistant slip layer is formed. The dye layer may be formed as a single layer of one color, or may be formed as a plurality of layers including different color dyes on the same surface of the same substrate, in a face serial manner. The dye layer is a layer comprising a thermal transferable dye supported by any desired binder. The usable dye is a dye which is thermally melted, diffused or transferred by sublimation. Any dye which have been used for sublimation transfer thermal transfer sheet known in the prior art can be used in the present invention. The dye to be used is properly selected in view of color tone, sensitivity in printing, weather resistance, storage stability, solubility in binder, and so on.

Specific examples of the dye include: diarylmethane dyes; triaryl methane dyes; thiazole dyes; methine dyes such as merocyanine or pyrazolone methine; azomethine dyes such as indoaniline, acetophenone azomethine, pyrazoloazomethine, imidazole azomethine, imidazoazomethine or pyridone azomethine; xanthene dyes; oxazine dyes; cyanomethylele dyes such as dicyanostyrene or tricyanostyrene; thiazine dyes; azine dyes; acridine dyes; benzeneazo dyes; azo dyes such as pyridoneazo, thiopheneazo, isothiazoleazo, pyrrol azo, pyral azo, imidazoleazo, thiadazoleazo, triazoleazo or disazo; spiropyran dyes; indolinospiropyran dyes; fluorane dyes; rhodamine lactam dyes; naphthoquinone dyes; anthraquinone dyes; quinophthalone dyes and so on.

The binder for the dye layer may be any known resin binder. Examples of preferable binder include: cellulose resins such as ethyl cellulose, hydroxyethyl cellulose, ethylhydroxy cellulose, hydroxypropyl cellulose, methyl cellulose, cellulose acetate and cellulose butyrate; vinyl resins such as polyvinyl alcohol, polyvinyl acetate, polyvinyl butyral, polyvinyl acetal, polyvinyl pyrrolidone and polyacrylamide; polyester resins; phenoxy resins and so on.

Also, silane coupling agent may be added to the dye layer. Examples of the silane coupling agent include isocyanate group-containing compounds such as γ-isocyanate propyltriethoxy silane or γ-isocyanate propyltrimethoxysilane; amino group-containing compounds such as γ-aminopropyltriethoxy silane, γ-aminopropyltrimethoxy silane, N-β-(aminoethyl)-γ-aminopropyltriethoxy silane or γ-phenylaminopropyltrimethoxy silane; epoxy group-containing compounds such as γ-glycidoxy propyltrimethoxy silane or β-(3,4-epoxycyclohexyl)ethyltrimethoxy silane and so on. These compounds may be used solely or in combination of two or more kinds.

It is considered that a silanol group produced by hydrolysis of the silane coupling agent is condensed with a hydroxyl group of an inorganic compound existing at the surface of the thin layer, thus improving the adhesiveness. Furthermore, the epoxy group, the amino group or the like of the silane coupling agent reacts with a hydroxy group, a carboxyl group or the like of the resin binder, and thereby the strength of the dye layer itself is enhanced and the break of the dye layer due to flocculation during thermal transfer can be prevented.

Instead of the resin binder, the present invention can use the following releasing graft copolymer or a releasing agent as a binder. The releasing graft copolymer is obtained by graft-polymerizing a polymer chain with at least one releasing segment selected from polysiloxane segment, fluorohydrocarbon segment or long chain alkyl segment. Among them, the graft copolymer obtained by graft-polymerizing a main chain of polyvinyl acetal resin with the polysiloxane segment is particularly preferable.

In the thermal transfer sheet of the present invention, the adhesiveness between the undercoat layer and the dye layer is likely to decrease after being left at high temperature and high humidity. From this reason, a highly adhesive resin having a hydroxy group or a carboxyl group such as polyvinyl butyral, polyvinyl acetal, polyvinyl acetate, or polyester resins, cellulose resins such as cellulose acetate or cellulose butyrate, and the like are suitably used solely or as a mixture, as the binder resin constituting the dye layer.

In addition to the above-mentioned dye and binder, various additives like as conventionally known may be added to the binder, if needed. Examples of additives include organic or inorganic fine particles such as polyethylene wax, for improving the releasing property of the image-receiving sheet or the coating property of ink. Usually, such a dye layer can be formed by dissolving or dispersing the above-mentioned dye, binder and optionally additives into an appropriate solvent to prepare a coating liquid, then applying this coating liquid onto the substrate followed by drying. This coating method can be achieved by a known method such as gravure printing, screen printing or reverse roll coating with a use of gravure plate. The dye layer formed in this manner has a coating amount of 0.2 to 6.0 g/m$^2$, preferable 0.3 to 3.0 g/m$^2$, on a dry basis.

(Heat Resistant Slip Layer)

In the thermal transfer sheet of the present invention, a heat resistant slip layer 4 is provided on one surface of the substrate in order to prevent a bad influence such as sticking from a heat of the thermal head, or printing wrinkle. The resin for forming the heat resistant slip layer may be any of conventionally known. For example, it may be polyvinyl butyral resin, polyvinyl acetoacetal resin, polyester resin, vinyl chloride-vinyl acetate copolymer, polyether resin, polybutadiene resin, styrene-butadiene copolymer, acrylpolyol, polyurethane acrylate, polyesteracrylate, polyetheracrylate, epoxy-acrylate, urethane or epoxy prepolymer, nitrocellulose resin, cellulose nitrate resin, cellulose acetate propionate resin, cellulose acetate butyrate resin, cellulose acetate hydrodiene phthalate resin, cellulose acetate resin, aromatic polyamide resin, polyimide resin, polyamideimide resin, polycarbonate resin, polyolefin chloride resin and so on.

The heat resistant slip layer may also be formed by adding a slipperiness-imparting agent to the resin, or by top-coating a slipperiness-imparting agent to the heat resistant slip layer formed of the resin. Specific examples of slipperiness-imparting agents include phosphoric esters, silicone oils, graphite powder, silicone graft polymers, fluoro graft polymers, acrylsilicone graft polymers, acrylsiloxanes, arylsiloxanes, and other silicone polymers. A preferred slipperiness-imparting agent comprises a polyol, for example, a high-molecular polyalcohol compound, a polyisocyanate compound and a phosphoric ester compound. In the present invention, the addition of a filler is more preferred.

The heat resistant slip layer can be formed by dissolving or dispersing the above-mentioned resin, the slipperiness-imparting agent and optionally additives into an appropriate solvent to prepare a coating liquid for heat resistant slip layer, then applying the coating liquid onto the substrate sheet by for example gravure printing, screen printing, reverse roll coating with a use of gravure plate followed by drying. The coating amount of the heat resistant slip layer is preferably 0.1 to 3.0 g/m$^2$ on solid component basis.

The present invention is not limited to the above-described embodiments. The above-described embodiments are for a purpose of illustrating. Whatever has substantially the same structure and effect as a technical concept described in claims of the invention is encompassed within the technical scope of the present invention.

EXAMPLES

The present invention will now be explained more in detail, with reference to Examples and Comparative Examples. However, the present invention is not limited to the following Examples. Hereinafter, "parts" or "%" is by weight unless otherwise specified.

Example A Series

First Embodiment

Example A1

Onto a substrate, which was polyethylene terephthalate (PET) film having a thickness of 4.5 μm, a coating liquid for an undercoat layer having the following composition was coated by gravure coating with the coating amount of 0.15 g/m$^2$ on a dry basis and dried at 110° C. for 1 minute, so that the undercoat layer was obtained. Onto the undercoat layer, a coating liquid for a dye layer having the following composition was coated by gravure coating with a coating amount of 0.7 g/m$^2$ on a dry basis and dried, so that the dye layer is obtained. Thus, a thermal transfer sheet of Example A1 was obtained. Onto the opposite surface of the substrate, a coating liquid for a heat resistant slip layer having the following composition was coated and dried with a coating amount of 1.0 g/m$^2$ on a dry basis, so that the heat resistant slip layer was obtained.

<Coating Liquid for Undercoat Layer A1>

Alumina sol (Alumina sol 200, feather-like form, NISSAN CHEMICAL INDUSTRIES, LTD., solid content 10%) 10 parts.

Polyamidepoxy resin (Sumirez Resin 675, Sumika Chemtex Co., Ltd., solid content 25%, molecular weight 1,000 to 10,000) 4 parts Water 40 parts Isopropyl alcohol 40 parts <Coating Liquid for Dye Layer>

C.I. solvent blue 63 6.0 parts Polyvinylbutyral resin (S-LEC BX-1, SEKISUI CHEMICAL CO., LTD.) 3.0 parts Methylethylketone 45.5 parts Toluene 45.5 parts <Coating Liquid for Heat Resistant Slip Layer>

Polyvinyl butyral resin (S-LEC BX-1, SEKISUI CHEMICAL CO., LTD.) 13.6 parts

Polyisocyanate curing agent (Takenate D218, Takeda Pharmaceutical Company Limited) 0.6 parts Phosphoric ester (Plysurf A208S, DAI-ICHI KOGYO SEIYAKU CO., LTD.) 0.8 parts Methylethylketone 42.5 parts Toluene 42.5 parts

Example A2

The thermal transfer sheet of Example A2 was obtained in a similar manner to Example A1, except that the composition of the undercoat layer was changed to the following composition.

<Coating Liquid A2 for Undercoat Layer>

Alumina sol (Alumina sol 200, feather-like form, NISSAN CHEMICAL INDUSTRIES, LTD., solid content 10%) 50 parts Polyamidepoxy resin (Sumirez Resin 675, Sumika Chemtex Co., Ltd., solid content 25%) 1 part Water 100 parts Isopropyl alcohol 100 parts

Example A3

The thermal transfer sheet of Example A3 was obtained in a similar manner to Example A1, except that the composition of the undercoat layer was changed to the following composition.

<Coating Liquid A3 for Undercoat Layer>

Alumina sol (Alumina sol 200, feather-like form, NISSAN CHEMICAL INDUSTRIES, LTD., solid content 10%) 25 parts Polyamidepoxy resin (Sumirez Resin 675, Sumika Chemtex Co., Ltd., solid content 25%) 2 parts Water 60 parts Isopropyl alcohol 60 parts

Example A4

The thermal transfer sheet of Example A4 was obtained in a similar manner to Example A1, except that the composition of the undercoat layer was changed to the following composition.

<Coating Liquid A4 for Undercoat Layer>

Colloidal silica (SNOWTEX OXS, particle size 4 to 6 nm, NISSAN CHEMICAL INDUSTRIES, LTD., solid content 10%) 25 parts Polyamidepoxy resin (Sumirez Resin 675, Sumika Chemtex Co., Ltd., solid content 25%) 2 parts Water 60 parts
Isopropyl alcohol 60 parts Example A5

The thermal transfer sheet of Example A5 was obtained in a similar manner to Example A1, except that the composition of the undercoat layer was changed to the following composition.

<Coating Liquid A5 for Undercoat Layer>

Alumina sol (Alumina sol 200, feather-like form, NISSAN CHEMICAL INDUSTRIES, LTD., solid content 10%) 15 parts Polyamidepoxy resin (Sumirez Resin 6615, Sumika Chemtex Co., Ltd., solid content 15%, molecular weight 1,000 to 10,000) 2 parts Water 60 parts Isopropyl alcohol 60 parts Example A6

The thermal transfer sheet of Example A6 was obtained in a similar manner to Example A1, except that the composition of the undercoat layer was change to the following composition.

<Coating Liquid A6 for Undercoat Layer)

Alumina sol (Alumina sol 200, feather-like form, NISSAN CHEMICAL INDUSTRIES, LTD., solid content 10%) 15 parts Polyamidepoxy resin (Sumirez Resin 650, Sumika Chemtex Co., Ltd., solid content 30%, molecular weight 1,000 to 5,000) 1 part Water 60 parts Isopropyl alcohol 60 parts Example A7

The thermal transfer sheet of Example A7 was obtained in a similar manner to Example A1, except that the composition of the undercoat layer was change to the following composition.

<Coating Liquid A7 for Undercoat Layer)

Alumina sol (Alumina sol 200, feather-like form, NISSAN CHEMICAL INDUSTRIES, LTD., solid content 10%) 15 parts Polyamidepoxy resin (WS 4002, SEIKO PMC CORPORATION, solid content 12.5%, molecular weight 10,000 to 100,000) 2.5 parts Water 60 parts Isopropyl alcohol 60 parts Comparative Example A1

The PET film as in the case of Example A1 was used as the substrate. Onto one surface of the substrate, the heat resistant slip layer was formed in advance as in the case of Example A1. Directly onto the substrate at the opposite side of the substrate where the heat resistant slip layer had been formed, the coating liquid for dye layer which was used in Example A1 was coated and dried in gravure coating with a coating amount of 0.7 g/m$^2$ on a dry basis to form the dye layer. As a result, the thermal transfer sheet of Comparative Example A1 was obtained.

Comparative Example A2

The PET film as in the case of Example A1 was used as the substrate. Onto one surface of the substrate, the heat resistant slip layer was formed in advance as in the case of Example A1. Onto the opposite surface of the substrate with the heat resistant slip layer, a coating liquid A8 for undercoat layer having the following composition was coated and dried in gravure coating with a coating amount of 0.15 g/m$^2$ on a dry basis to form the undercoat layer. Onto the undercoat layer, the dye layer was formed in a similar manner as in the case of Example A1. As a result, the thermal transfer sheet of Comparative Example A2 was obtained.

<Coating Liquid A8 for Undercoat Layer>

Alumina sol (Alumina sol 200, feather-like form, NISSAN CHEMICAL INDUSTRIES, LTD., solid content 10%) 10 parts Water 20 parts Isopropyl alcohol 20 parts Comparative Example A3

The PET film as in the case of Example A1 was used as the substrate. Onto one surface of the substrate, the heat resistant slip layer was formed in advance as in the case of Example A1. Onto the opposite surface of the substrate with the heat resistant slip layer, a coating liquid A9 for undercoat layer having the following composition was coated and dried in gravure coating with a coating amount of 0.15 g/m$^2$ on a dry basis to form the undercoat layer. Onto the undercoat layer, the dye layer was formed in a similar manner as in the case of Example A1. As a result, the thermal transfer sheet of Comparative Example A3 was obtained.

<Coating Liquid A9 for Undercoat Layer>

Alumina sol (Alumina sol 200, feather-like form, NISSAN CHEMICAL INDUSTRIES, LTD., solid content 10%) 70 parts Isocyanate compound (F-38387D, DAI-ICHI KOGYO SEIYAKU CO., LTD., solid content 31.5%) 20 parts Tin catalyst (Elastron catalyst 64, DAI-ICHI KOGYO SEIYAKU CO., LTD.) 1 part Water 310 parts Isopropyl alcohol 310 parts Comparative Example A4

The PET film as in the case of Example A1 was used as the substrate. Onto one surface of the substrate, the heat resistant slip layer was formed in advance as in the case of Example A1. Onto the opposite surface of the substrate with the heat resistant slip layer, a coating liquid A10 for undercoat layer having the following composition was coated and dried in gravure coating with a coating amount of 0.15 g/m$^2$ on a dry basis to form the undercoat layer. Onto the undercoat layer, the dye layer was formed in a similar manner as in the case of Example A1. As a result, the thermal transfer sheet of Comparative Example A4 was obtained.

<Coating Liquid A10 for Undercoat Layer>

Alumina sol (Alumina sol 200, feather-like form, NISSAN CHEMICAL INDUSTRIES, LTD., solid content 10%) 25 parts Acryl silicon emulsion (Aquabrid 903, Daicel Chemical Industries, Ltd., solid content 27%) 2 parts Water 60 parts Isopropyl alcohol 60 parts <Cyan Reflection Density>

Using thermal transfer sheets obtained in each Example and each Comparative Example as mentioned above in combination with a thermal transfer image-receiving sheet specially designed for P-400 printer available from OLYMPUS CORPORATION, printing is performed with the following conditions. The cyan reflection density was measured with Macbeth reflection density meter RD-918.

(Printing Conditions)

Thermal head; KGT-217-12MPL20 (manufactured by KYOCERA Corporation)

Average resistance of heating element; 2994 (Ω)

Print density in main scanning direction; 300 dpi

Print density in sub scanning direction; 300 dpi

Applied voltage; 0.10 (w/dot)

One line period; 5 (msec)

Printing start temperature; 40 (° C.)

Applied pulse (Gradation Control Method); Using a test printer of multi-pulse mode which can adjust the number of divided pulses having a pulse length obtained by equally dividing the one line period into 256 from 0 to 255 in one line period, a duty ratio of each divided pulse was fixed at 70%, and the number of pulses per line period was separated into 15 levels between 0 and 255. Thereby, 15 levels of different energies can be provided.

As for each printed matter from each Example and each Comparative Example, the reflection density was measured at density max (255th gradation). The obtained reflection density was evaluated according to the following criteria.

○: The reflection density at density max is 2.33 or more.

Δ: The reflection density at density max is 2.29 or more and less than 2.33.

x: The reflection density at density max is less than 2.29.

<Adhesive Strength of Dye Layer>

Using thermal transfer sheets obtained as mentioned above, Sellotape (registered trademark) was stuck on the dye layer by rubbing the tape against the dye layer two times with a thumb. Immediately after that, the tape was peeled off from the dye layer. The residue of the dye layer on the tape was observed. Observation criteria were as follows.

○: No residue of dye layer was observed.

Δ: A little amount of residue of dye layer was observed x: The residue of dye layer was observed over the entire surface.

<Evaluation of Transferability After Being Stored>

Thermal transfer sheets obtained from each Example and each Comparative Example were stored for 100 hours at 40° C. and 90% RH. After that, printing was performed for each sheet with the same printing conditions and printing pattern as in the case of measurement of the reflection density. During printing, it was observed with eyes whether or not the dye layer of the thermal transfer sheet thermally fuses with the thermal transfer image-receiving sheet, or whether or not the so-called "abnormal transfer", that is the dye layer itself is transferred to the thermal transfer image-receiving sheet, was caused. The evaluation criteria were as follows.

◎: The dye layer does not thermally fuse with the thermal transfer image-receiving sheet and no abnormal transfer was caused.

○: The dye layer does not thermally fuse with the thermal transfer image-receiving sheet and the abnormal transfer was not caused. However, with regard to the releasability between dye layer and image-receiving sheet after printing, the resistance force against peeling was slightly higher than the above "◎" level.

Δ: The partial dye layer thermally fuses with the thermal transfer image-receiving sheet or a little bit abnormal transfer was caused.

x: The dye layer thermally fuses with the thermal transfer image-receiving sheet or the abnormal transfer was caused.

The results of the above-mentioned reflection density measurement and evaluation, the adhesive strength of dye layer and transferability after being stored were listed in Table 1.

TABLE 1

| | Undercoat Layer (Solid Content Ratio) | Reflection Density | | Adhesive Strength of Dye Layer | Transferability after being stored at 40° C., 90% RH |
|---|---|---|---|---|---|
| Example A1 | Alumina sol:Polyamide epoxy resin = 1:1 | 2.37 | ○ | ○ | ◎ |
| Example A2 | Alumina sol:Polyamide epoxy resin = 1:0.05 | 2.49 | ○ | ○ | ○ |
| Example A3 | Alumina sol:Polyamide epoxy resin = 1:0.2 | 2.43 | ○ | ○ | ○ |
| Example A4 | Colloidal silica:Polyamide epoxy resin = 1:0.2 | 2.36 | ○ | ○ | ○ |
| Example A5 | Alumina sol:Polyamide epoxy resin = 1:0.2 | 2.44 | ○ | ○ | ○ |
| Example A6 | Alumina sol:Polyamide epoxy resin = 1:0.2 | 2.41 | ○ | ○ | ○ |
| Example A7 | Alumina sol:Polyamide epoxy resin = 1:0.21 | 2.40 | ○ | ○ | ○ |
| Comparative Example A1 | — | — | X | X | X |
| Comparative Example A2 | Alumina sol | 2.51 | ○ | ○ | Δ~X |
| Comparative Example A3 | Alumina sol:Block isocyanate:Catalyst = 1:0.9:0.14 | 2.41 | ○ | ○ | Δ |
| Comparative Example A4 | Alumina sol:Acryl silicone resin = 1:0.2 | 2.31 | Δ | ○ | ○ |

From the above results, all of the thermal transfer sheets of Examples A1 to A7, each of which was provided with the undercoat layer comprising the water soluble self cross-linking resin and the colloidal inorganic pigment ultrafine particles between the substrate and the dye layer, had the above reflection densities of 2.36 or more which were high densities. In these sheets, the content ratio of the colloidal ultrafine particles to the resin (Colloidal inorganic pigment ultrafine particles/Water soluble self cross-linking resin) was 1/1 to 1/0.05. As for all of the thermal transfer sheets of Examples, the transferability after being stored was also good, and the adhesiveness of the dye layer to the substrate had no problem.

The thermal transfer sheet of Comparative Example A1, which had no undercoat layer and had the dye layer formed directly on the substrate, shows a practical problem about the adhesiveness of the dye layer to the substrate, and the transferability of the thermal transfer sheet and the thermal transfer image-receiving sheet after being stored at high temperature and high humidity. Thus, the satisfactory printed matter having the high density cannot be presented. Also, Comparative Example A2, which had the undercoat layer made of the colloidal inorganic pigment ultrafine particles only between the substrate and the dye layer, showed a problem about the transferability of the thermal transfer sheet and the thermal transfer image-receiving sheet after being stored at high temperature and high humidity, although it showed the good reflection density of the printed matter and the good adhesiveness of the dye layer to the substrate.

Comparative Example A3, which had the undercoat layer made of alumina sol, block isocyanate and catalyst, showed a slight problem about the transferability of the thermal transfer sheet and the thermal transfer image-receiving sheet after being stored at high temperature and high humidity, although it showed the good reflection density of the printed matter and the adhesiveness of the dye layer to the substrate. Comparative Example A4, which had the undercoat layer made of alumina sol and acryl silicone resin, showed the unsatisfactory reflection density of 2.31, although it showed the good adhesiveness of the dye layer to the substrate, and the good transferability of the thermal transfer sheet and the thermal transfer image-receiving sheet after being stored at high temperature and high humidity.

Example B Series

Second Embodiment

Example B1

Onto a substrate, which was polyethylene terephthalate (PET) film having a thickness of 4.5 μm, a coating liquid for an undercoat layer having the following composition was coated and dried by gravure coating so that the coating amount would be shown in Table 2 and then the undercoat layer was obtained. Onto the undercoat layer, a coating liquid for a dye layer having the following composition was coated and dried by gravure coating with a coating amount of 0.7 $g/m^2$ on a dry basis, so that the dye layer was obtained. Thus, a thermal transfer sheet of Example B1 was obtained. Onto the opposite surface of the substrate, a coating liquid for a heat resistant slip layer having the following composition was coated and dried in advance with a coating amount of 1.0 $g/m^2$ on a dry basis, so that the heat resistant slip layer was obtained.

<Coating Liquid B1 for Undercoat Layer>

Alumina sol (Alumina sol 200, feather-like form, NISSAN CHEMICAL INDUSTRIES, LTD., solid content 10%) 28 parts.

Vinyl pyrrolidone/vinyl acetate copolymer resin (E-735, ISP, solid content 50%) 1.4 parts Pure water (SEIKI CO., LTD.) 22.7 parts Isopropyl alcohol 47.9 parts <Coating Liquid for Dye Layer>

C.I. solvent blue 63 6.0 parts

Polyvinyl butyral resin (S-LEC BX-1, SEKISUI CHEMICAL CO., LTD.) 3.0 parts

Methylethylketone 45.5 parts

Toluene 45.5 parts

<Coating Liquid for Heat resistant slip layer>

Polyvinyl butyral resin (S-LEC BX-1, SEKISUI CHEMICAL CO., LTD.) 13.6 parts

Polyisocyanate curing agent (Takenate D218, Takeda Pharmaceutical Company Limited) 0.6 parts Phosphoric ester (Plysurf A208S, DAI-ICHI KOGYO SEIYAKU CO., LTD.) 0.8 parts Methylethylketone 42.5 parts Toluene 42.5 parts

Example B2

The thermal transfer sheet of Example B2 was obtained in a similar manner to Example B1, except that the composition of the undercoat layer was changed to the following composition.

<Coating Liquid B2 for Undercoat Layer>

Alumina sol (Alumina sol 200, feather-like form, NISSAN CHEMICAL INDUSTRIES, LTD., solid content 10%) 28 parts.

Vinyl pyrrolidone/vinyl acetate copolymer resin (E-635, ISP, solid content 50%) 1.4 parts Pure water (SEIKI CO., LTD.) 22.7 parts Isopropyl alcohol 47.9 parts

Example B3

The thermal transfer sheet of Example B3 was obtained in a similar manner to Example B1, except that the composition of the undercoat layer was changed to the following composition.

<Coating Liquid B3 for Undercoat Layer>

Alumina sol (Alumina sol 200, feather-like form, NISSAN CHEMICAL INDUSTRIES, LTD., solid content 10%) 28 parts.

Vinyl pyrrolidone/vinyl acetate copolymer resin (E-535, ISP, solid content 50%) 1.4 parts Pure water (SEIKI CO., LTD.) 22.7 parts Isopropyl alcohol 47.9 parts

Example B4

The thermal transfer sheet of Example B4 was obtained in a similar manner to Example B1, except that the composition of the undercoat layer was changed to the following composition.

<Coating Liquid B4 for Undercoat Layer>

Alumina sol (Alumina sol 200, feather-like form, NISSAN CHEMICAL INDUSTRIES, LTD., solid content 10%) 28 parts.

Vinyl pyrrolidone/vinyl acetate copolymer resin (E-335, ISP, solid content 50%) 1.4 parts Pure water (SEIKI CO., LTD.) 22.7 parts Isopropyl alcohol 47.9 parts Example B5

The thermal transfer sheet of Example B5 was obtained in a similar manner to Example B1, except that the composition of the undercoat layer was changed to the following composition.

<Coating Liquid B5 for Undercoat Layer>

Alumina sol (Alumina sol 200, feather-like form, NISSAN CHEMICAL INDUSTRIES, LTD., solid content 10%) 24.5 parts.

Vinyl pyrrolidone/vinyl acetate copolymer resin (E-335, ISP, solid content 50%) 2.1 parts Pure water (SEIKI CO., LTD.) 26.2 parts Isopropyl alcohol 47.2 parts Example B6

The thermal transfer sheet of Example B6 was obtained in a similar manner to Example B5, except that the coating amount of the undercoat layer on a dry basis was changed to a value listed in Table 2.

Example B7

The thermal transfer sheet of Example B7 was obtained in a similar manner to Example B5, except that the coating amount of the undercoat layer on a dry basis was changed to a value listed in Table 2.

Example B8

The thermal transfer sheet of Example B8 was obtained in a similar manner to Example B, except that the composition of the undercoat layer was changed to the following composition.

<Coating Liquid B6 for Undercoat Layer>

Alumina sol (Alumina sol 200, feather-like form, NISSAN CHEMICAL INDUSTRIES, LTD., solid content 10%) 21 parts.

Vinyl pyrrolidone/vinyl acetate copolymer resin (E-335, ISP, solid content 50%) 2.8 parts Pure water (SEIKI CO., LTD.) 29.4 parts Isopropyl alcohol 46.8 parts Example B9

The thermal transfer sheet of Example B9 was obtained in a similar manner to Example B1, except that the composition of the undercoat layer was changed to the following composition.

<Coating Liquid B7 for Undercoat Layer>

Alumina sol (Alumina sol 200, feather-like form, NISSAN CHEMICAL INDUSTRIES, LTD., solid content 10%) 24.5 parts.

Vinyl pyrrolidone/vinyl acetate copolymer resin (E-535, ISP, solid content 50%) 2.1 parts Pure water (SEIKI CO., LTD.) 26.2 parts Isopropyl alcohol 47.2 parts Example B10

The thermal transfer sheet of Example B10 was obtained in a similar manner to Example B1, except that the composition of the undercoat layer was changed to the following composition.

<Coating Liquid B8 for Undercoat Layer>

Alumina sol (Alumina sol 200, feather-like form, NISSAN CHEMICAL INDUSTRIES, LTD., solid content 10%) 24.5 parts.

Vinyl pyrrolidone/vinyl acetate copolymer resin (E-735, ISP, solid content 50%) 2.1 parts Pure water (SEIKI CO., LTD.) 26.2 parts Isopropyl alcohol 47.2 parts Example B11

The thermal transfer sheet of Example B11 was obtained in a similar manner to Example B1, except that the composition of the undercoat layer was changed to the following composition.

<Coating Liquid B9 for Undercoat Layer>

Alumina sol (Alumina sol 200, feather-like form, NISSAN CHEMICAL INDUSTRIES, LTD., solid content 10%) 31.5 parts.

Vinyl pyrrolidone/vinyl acetate copolymer resin (E-335, ISP, solid content 50%) 0.7 parts Pure water (SEIKI CO., LTD.) 19.9 parts Isopropyl alcohol 39.9 parts Example B12

The thermal transfer sheet of Example B12 was obtained in a similar manner to Example B1, except that the composition of the undercoat layer was changed to the following composition.

<Coating Liquid B10 for Undercoat Layer>

Alumina sol (Alumina sol 200, feather-like form, NISSAN CHEMICAL INDUSTRIES, LTD., solid content 10%) 17.5 parts.

Vinyl pyrrolidone/vinyl acetate copolymer resin (E-335, ISP, solid content 50%) 3.5 parts Pure water (SEIKI CO., LTD.) 32.5 parts Isopropyl alcohol 46.5 parts Comparative Example B1

The PET film as in the case of Example B1 was used as the substrate. Onto one surface of the substrate, the heat resistant slip layer was formed in advance as in the case of Example B1. Onto the opposite surface of the substrate with the heat resistant slip layer, a coating liquid B11 for undercoat layer having the following composition was coated and dried in gravure coating so that a coating amount on a dry basis would be a value listed in Table 2 to form the undercoat layer. Onto the undercoat layer, the dye layer was formed in a similar manner as in the case of Example B1. As a result, the thermal transfer sheet of Comparative Example B1 was obtained.

<Coating Liquid B11 for Undercoat Layer>

Alumina sol (Alumina sol 200, feather-like form, NISSAN CHEMICAL INDUSTRIES, LTD., solid content 10%) 35 parts Pure water (SEIKI CO., LTD.) 16.75 parts Isopropyl alcohol 48.25 parts Comparative Example B2

The thermal transfer sheet of Comparative Example B2 was obtained in a similar manner to Comparative Example B1, except that the coating amount of the undercoat layer on the on a dry basis would be a value listed in Table 2.

Comparative Example B3

The thermal transfer sheet of Comparative Example B3 was obtained in a similar manner to Comparative Example B1, except that the composition of the undercoat layer was changed to the following composition.

<Coating Liquid B12 for Undercoat Layer>

Alumina sol (Alumina sol 200, feather-like form, NISSAN CHEMICAL INDUSTRIES, LTD., solid content 10%) 24.5 parts.

Polyvinyl pyrrolidone resin (K-90, ISP) 1.05 parts

Pure water (SEIKI CO., LTD.) 26.2 parts

Isopropyl alcohol 48.25 parts

Comparative Example B4

The thermal transfer sheet of Comparative Example B4 was obtained in a similar manner to Comparative Example B1, except that the composition of the undercoat layer was changed to the following composition.

<Coating Liquid B13 for Undercoat Layer>

Vinyl pyrrolidone/vinyl acetate copolymer resin (E-335, ISP, solid content 50%) 7.0 parts Pure water (SEIKI CO., LTD.) 46.5 parts Isopropyl alcohol 43.0 parts Comparative Example B5

The thermal transfer sheet of Comparative Example B5 was obtained in a similar manner to Comparative Example B1, except that the composition of the undercoat layer was changed to the following composition.

<Coating Liquid B14 for Undercoat Layer>

Vinyl acetate resin (HR-3010, KURARAY CO., LTD) 3.5 parts

Pure water (SEIKI CO., LTD.) 48.25 parts

Isopropyl alcohol 48.25 parts

<Adhesive Strength of Dye Layer (Room Temperature)>

Using thermal transfer sheets obtained as mentioned above, Sellotape (registered trademark, 200 mm long by 12 mm wide) was stuck on each dye layer of each thermal transfer sheet after being stored at a room temperature by rubbing the tape against the dye layer two times with a thumb. Immediately after that, the tape was peeled off from the dye layer. The residue of the dye layer on the tape was observed. Observation criteria were as follows.

○: No residue of dye layer was observed.

Δ: A little amount of residue of dye layer was observed x: The residue of dye layer was observed over the entire surface.

<Adhesive Strength of Dye Layer (High Temperature and High Humidity)>

Thermal transfer sheets obtained as mentioned above were stored for 100 hours at 40° C. and 90% RH. Then, sheets were left at a room temperature for 24 hours. After that, the adhesive strength was evaluated for each sheets in a similar manner to the above-mentioned adhesive evaluation. Observation criteria were as follows.

○: No residue of dye layer was observed.

Δ: A little amount of residue of dye layer was observed x: The residue of dye layer was observed over the entire surface.

<Evaluation of Transferability After Being Stored>

Thermal transfer sheets obtained from each Example and each Comparative Example were stored for 100 hours at 40° C. and 90% RH. After that, whole solid pattern (gradation value 255/255) was printed at 45° C. and 60% RH, using a combination of each post-stored sheet and a thermal transfer image-receiving sheet specially designed for P-400 printer available from OLYMPUS CORPORATION. After printing, it was observed with eyes whether or not the dye layer of the thermal transfer sheet thermally fuses with the thermal transfer image-receiving sheet, or whether or not the so-called "abnormal transfer", that is the dye layer itself is transferred to the thermal transfer image-receiving sheet, was caused.

(Printing Conditions)

Thermal head; F3598 (Toshiba Hokuto Electronics Corporation)

Average resistance of heating element; 5176 (Ω)

Print density in main scanning direction; 300 dpi

Print density in sub scanning direction; 300 dpi

Applied voltage; 0.11 (w/dot)

One line period; 2.0 (msec)

Pulse duty; 85%

Printing start temperature; 35.5 (° C.)

The evaluation criteria were as follows.

○: The dye layer does not thermally fuse with the thermal transfer image-receiving sheet and the abnormal transfer was not caused.

x: The dye layer thermally fuses with the thermal transfer image-receiving sheet or the abnormal transfer was caused.

<Evaluation of "Burnt Deposit">

Using thermal transfer sheets obtained in each Example and each Comparative Example in combination with a thermal transfer image-receiving sheet specially designed for P-400 printer available from OLYMPUS CORPORATION, black whole solid pattern was printed by superimposing sequentially three color dyes (yellow, magenta and cyan) and the protective layer at last. It was observed whether or not the "burnt deposit" is caused in the black whole solid pattern of the printed matter. As the thermal transfer sheet including yellow, magenta and protective layer, a thermal transfer sheet for MEGA PIXEL III available from Altech ADS Co., Ltd. was used. The black reflection density was determined by measuring the black reflection density at a point randomly selected within an area where the "burnt deposit" was not caused, with a use of Macbeth reflection density meter RD-918.

(Printing Conditions)

Thermal head; F3598 (Toshiba Hokuto Electronics Corporation)

Average resistance of heating element; 5323 (Ω)

Print density in main scanning direction; 300 dpi

Print density in sub scanning direction; 300 dpi

Applied voltage; 0.11 (w/dot)

One line period; 0.7 (msec)

Pulse duty; 96%

Printing start temperature; 28 (° C.)

The evaluation of "burnt deposit" was based on the following criteria.

5: "burnt deposit" was observed at 50% or more relative to the entire area of the printed matter.

4: "burnt deposit" was observed at about 40% relative to the entire area of the printed matter.

3: "burnt deposit" was observed at about 30% relative to the entire area of the printed matter.

2: "burnt deposit" was observed at about 10% relative to the entire area of the printed matter.

1: "burnt deposit" was not observed with eyes.

In this regard, the "burnt deposit" means a phenomenon that the surface of the printed matter becomes matt and lusterless because of an image degradation which is caused at a black high density area, i.e. a change of color phase occurs in a black part due to the thermal fusion between the receiving layer of the thermal transfer image-receiving sheet and the thermal transfer sheet during transferring, when a black thermal transfer image is formed by superimposing sequentially three color dyes including each dye layer of yellow, magenta and cyan, and a protective layer which is finally transferred from a protective layer transfer sheet.

The result of the black reflection density measurement, the adhesiveness of the dye layer (at room temperature, at high temperature and high humidity), the transferability evaluation after being stored and "burnt deposit" evaluation are shown in Table 2.

TABLE 2

| | Ultrafine particles/ Copolymer resin (weight ratio) | Vinyl pyrrolidone/ Vinyl acetate (mol ratio) | Coating amount of Dye layer ($g/m^2$) | Adhesiveness (room temperature) | Adhesiveness (high temperature and high humidity) | Transferability Evaluation after being stored (high temperature and high humidity) | "Burnt deposit" evaluation | Black reflection density |
|---|---|---|---|---|---|---|---|---|
| Example B1 | 8/2 | 70/30 | 0.19 | ○ | ○ | ○ | 2 | 2.10 |
| Example B2 | 8/2 | 60/40 | 0.17 | ○ | ○ | ○ | 2 | 2.09 |
| Example B3 | 8/2 | 50/50 | 0.15 | ○ | ○ | ○ | 2 | 2.11 |
| Example B4 | 8/2 | 30/70 | 0.15 | ○ | ○ | ○ | 2 | 2.14 |
| Example B5 | 7/3 | 30/70 | 0.18 | ○ | ○ | ○ | 1 | 2.10 |
| Example B6 | 7/3 | 30/70 | 0.24 | ○ | ○ | ○ | 2 | 2.12 |
| Example B7 | 7/3 | 30/70 | 0.33 | ○ | ○ | ○ | 3 | 2.15 |
| Example B8 | 6/4 | 30/70 | 0.15 | ○ | ○ | ○ | 1 | 2.02 |
| Example B9 | 7/3 | 50/50 | 0.16 | ○ | ○ | ○ | 1 | 2.13 |
| Example B10 | 7/3 | 70/30 | 0.17 | ○ | ○ | ○ | 2 | 2.14 |
| Example B11 | 9/1 | 30/70 | 0.15 | ○ | ○ | ○ | 3 | 2.15 |
| Example B12 | 5/5 | 30/70 | 0.16 | Δ | Δ | ○ | 3 | 2.01 |
| Comparative Example B1 | 10/0 | — | 0.31 | Δ | X | X | 5 | 2.16 |
| Comparative Example B2 | 10/0 | — | 0.15 | Δ | X | X | 3 | 2.14 |
| Comparative Example B3 | 7/3 | 100/0 | 0.15 | ○ | Δ | X | 4 | 2.08 |
| Comparative Example B4 | 0/10 | 70/30 | 0.15 | Δ | X | X | 2 | 1.87 |
| Comparative Example B5 | — | 0/100 | 0.15 | Δ | Δ | X | 2 | 1.89 |

From the above results, when using the undercoat layer comprising, as main components, a copolymer resin of vinyl pyrrolidone and vinyl acetate and colloidal inorganic pigment ultrafine particles, the black reflection density of 2.0 or more was obtained. When the solid content ratio by weight of the colloidal inorganic pigment ultrafine particles to the copolymer resin of vinyl pyrrolidone and vinyl acetate was within 8/2 to 6/4 and the coating amount of the undercoat layer on the on a dry basis was within 0.15 to 0.25 $g/m^2$, particularly, a high density print can be obtained with less "burnt deposit", and the good adhesiveness of the dye layer relative to the substrate after being stored at room temperature or at high temperature and high humidity, and the good transferability after being stored at high temperature and high humidity. In the thermal transfer sheet of Example 7, although the coating amount is more than the range from 0.15 to 0.25 $g/m^2$, a few more "burnt deposit" was observed. In thermal transfer sheets of Examples 11 and 12, each comprising, as main components, a copolymer resin of vinyl pyrrolidone and vinyl acetate and colloidal inorganic pigment ultrafine particles, the solid content ratios by weight of the colloidal inorganic pigment ultrafine particles to the copolymer resin of vinyl pyrrolidone and vinyl acetate were 9/1 and 5/5, respectively, and "burnt deposit" was more observed or the adhesiveness was decreased.

The thermal transfer sheets of Comparative Examples 1 and 2, each having the undercoat layer made of colloidal inorganic pigment ultrafine particles only between the substrate and the dye layer, showed less adhesiveness between the substrate and dye layer, although showed good black reflection density of printed matter. Particularly, the transferability after being stored at high temperature and high humidity was unsatisfactory and the "burnt deposit" phenomenon was worse. In Comparative Example 3, since the polyvinyl pyrrolidone resin which is not modified by vinyl acetate was used for the undercoat layer, the transferability after being stored at high temperature and high humidity was unsatisfactory and the "burnt deposit" phenomenon was worse.

In Comparative Example 4, since the undercoat layer is constituted only by a copolymer of vinyl pyrrolidone and vinyl acetate without containing colloidal inorganic pigment ultrafine particles, the transfer sensitivity especially in a high speed printing was unsatisfactorily lower than that of any other Example. Additionally, the transferability after being stored at high temperature and high humidity was unsatisfactory. In Comparative Example 5, since the undercoat layer is constituted only by a vinyl acetate resin, the transfer sensitivity in a high speed printing was low as in the case of Comparative Example 4. Thereby, the print density was decreased. Additionally, the transferability after being stored at high temperature and high humidity was unsatisfactory.

The invention claimed is:

1. A thermal transfer sheet comprising:

a substrate;

a heat resistant slip layer provided on one side of the substrate;

an undercoat layer and a dye layer provided in that order on the other side of the substrate, wherein the undercoat layer is formed by applying and drying a coating liquid which contains, as main components, a water soluble self cross-linking resin and colloidal inorganic pigment ultrafine particles, and cross-linking polymerizing the water soluble self cross-linking resin;

wherein the total amount of the water soluble self cross-linking resin and colloidal inorganic pigment ultrafine particles is 95% by weight or more of a solid content of the undercoat layer; and wherein the solid content ratio by weight of the colloidal inorganic pigment ultrafine particles to the water soluble self cross-linking resin is 1/1 to 1/0.05.

2. The thermal transfer sheet according to claim 1, wherein the water soluble self cross-linking resin is polyamide epoxy resin.

3. The thermal transfer sheet according to claim 1, wherein the colloidal inorganic pigment ultrafine particles are colloidal silica and/or alumina sol.

4. The thermal transfer sheet according to claim 1, wherein the water soluble self cross-linking resin is a polyamide epoxy resin or a urea-formaldehyde resin.

* * * * *